United States Patent [19]

Clegg

[11] Patent Number: 5,030,892

[45] Date of Patent: Jul. 9, 1991

[54] MEANS FOR PREVENTING DAMAGE TO ELECTRONIC BALLASTS AS A RESULT OF FAILURE OF GAS DISCHARGE LAMPS

[75] Inventor: John C. Clegg, Provo, Utah

[73] Assignee: Brigham Young University, Provo, Utah

[21] Appl. No.: 347,177

[22] Filed: May 3, 1989

[51] Int. Cl.[5] ..... H05B 37/00

[52] U.S. Cl. ..... 315/227 R; 315/241 R; 315/310; 315/DIG. 5

[58] Field of Search ..... 315/227 R, 239, 291, 315/307, 310, DIG. 5, 241 R

[56] References Cited

U.S. PATENT DOCUMENTS

| | | | |
|---|---|---|---|
| 3,579,026 | 5/1971 | Paget . | |
| 4,042,852 | 8/1977 | Zaderej et al. . | |
| 4,207,497 | 6/1980 | Capewell et al. . | |
| 4,207,498 | 6/1980 | Spira et al. . | |
| 4,210,846 | 7/1980 | Capewell et al. . | |
| 4,349,863 | 9/1982 | Petersen . | |
| 4,388,562 | 6/1983 | Josephson . | |
| 4,508,996 | 4/1985 | Clegg et al. . | |
| 4,513,226 | 4/1985 | Josephson . | |
| 4,806,830 | 2/1989 | Ueki | 315/DIG. 5 X |

OTHER PUBLICATIONS

Campbell, John H., "New Parameters for High Frequency Lighting", *Illuminating Engineering*, May 1960, pp. 247-256.

*Primary Examiner*—Robert J. Pascal

*Attorney, Agent, or Firm*—Knobbe, Martens, Olson & Bear

[57] ABSTRACT

The present invention discloses a means and method for preventing damage to electronic ballasts for high frequency lamps. In normal use lamps assume rectifying characteristics and generate direct current which interferes with the proper functioning of the system. In one aspect of the invention, a capacitor is used to prevent damage caused by this direct current. In another aspect of the invention, the capacitor also reduces the operating voltage of the lamps while preventing damage caused by the direct current. Another aspect of the invention gives added control of the filament voltage before and after the ignition of the lamps. In a further aspect of the invention, a capacitor is connected in series with the primary of the filament transformer to prevent damage caused by a short circuited secondary.

25 Claims, 3 Drawing Sheets

MEANS FOR PREVENTING DAMAGE TO ELECTRONIC BALLASTS AS A RESULT OF FAILURE OF GAS DISCHARGE LAMPS

FIELD OF THE INVENTION

The present invention relates to the field of fluorescent lamp systems. More specifically, the invention relates to high-frequency electronic ballasts for gas discharge electric lamps. Most specifically, the present invention relates to a means and method for preventing damage to electronic ballasts due to the failure of fluorescent lamps, and for controlling the voltage applied to filament transformers.

BACKGROUND OF THE INVENTION

In the fluorescent lighting industry, it is common practice to use a ballast, typically an inductor or a capacitor, to control the flow of alternating current. High-frequency fluorescent lighting systems, however, utilize an electronic ballast circuit which includes a ballast together with an inverter for generating a high frequency electric current which supplies virtually all of the power needed to operate the lamps. Also, a filament transformer is sometimes included in the electronic ballast circuit to heat the filaments of the lamps.

Existing electronic ballast circuits controlling high-frequency lamps have a tendency to overheat and fail when the lamps near the end of their lives. The gas discharge lamps operate on alternating current (AC) with the current flowing through the lamps in both directions, between two electrodes that act alternately as the cathode and the anode, and vice versa. Frequently, as the lamps become older one of the two electrodes loses its ability to emit electrons while the other electrode does not. When this occurs, the lamp conducts electric current more readily in one direction than the other. Thus, the lamp assumes the characteristics of a rectifier and generates direct current (DC) from the alternating current normally supplied to it. The direct current can burn out the primary winding of the filament transformer if that winding is connected to the rectifying lamp in such a way that direct current can flow through a closed path that includes the lamp and the filament transformer. This direct current is produced by the lamp and not by the high-frequency generator or inverter which furnishes AC power to operate the lamp, ballast and filament transformer combination.

This problem may cause significant additional harm in electronic ballast circuits that utilize an inductive ballast. An inductive ballast cannot block the flow of direct current. Thus, even a small DC current tends to saturate the magnetic core of the ballast. This reduces the inductance of the ballast and, therefore, interferes with its ability to limit or control the flow of alternating current. Thus, not only the magnitude of DC current but also the AC current can increase to a level which may damage the ballast inductor and other components in the inverter.

This is an unrecognized problem, especially in the case of high-frequency fluorescent lamps systems. Existing prior art systems, such as Paget U.S. Pat. No. 3,579,026 (FIG. 1), Zaderej U.S. Pat. No. 4,042,852, Spira U.S. Pat. No. 4,027,498, Capewell U.S. Pat. Nos. 4,207,497 and 4,210,846 (FIG. 4), Josephson U.S. Pat. Nos. 4,388,562 (FIG. 1) and 4,513,226, and Petersen U.S. Pat. No. 4,349,863 (FIG. 2) show designs in the indicated figures which are susceptible to damage as a result of excessive direct current.

In particular, with respect to low-frequency applications, ballast inductors have a relatively high winding resistance which is more effective in limiting the flow of direct current. Thus, low frequency ballasts heat up relatively slowly, enabling an over-temperature thermostat which is typically incorporated within the ballast, to turn off the power before any significant damage to the ballast occurs.

High-frequency ballast inductors, on the other hand, have a low winding resistance since a lower inductance is sufficient to control lamp current. In some cases, larger diameter wire is utilized to reduce electrical resistance and maximize efficiency. Due to this reduced resistance, the direct current resulting from the rectifying lamp can be much greater in high-frequency systems than in more familiar systems. This damages the ballast inductor or the inverter quickly before the protective thermostat has time to respond. For example, in some cases direct current through the lamp and ballast has been measured at four amperes, or about 10 times the normal lamp current.

Electronic ballast circuits for rapid-start fluorescent lighting applications sometimes include a filament transformer for heating the cathodes of the lamps. The voltage across the primary of the filament transformer is obtained directly from the high voltage across one or more lamps. The high-voltage primary winding of the filament transformer is therefore easily damaged by direct current from a rectifying lamp.

Presently available ballasts utilizing capacitors for the current limiting function do not conduct direct current. However, even though the ballast capacitors prevent damage to themselves and to the inverter components from rectifying lamps, they do not protect the filament transformers.

SUMMARY OF THE INVENTION

Over the years, electronic ballasts for high frequency lamps have frequently been damaged due to reasons previously undiscovered by others. Briefly stated, the present invention advantageously comprises means for preventing damage to electronic ballasts. Failure of electronic ballasts is often due to the lamp acting as a rectifier and generating excessive direct current (DC). In a preferred embodiment of the present invention, the means for preventing damage comprises a capacitor connected in series with every path, through a lamp or a series of lamps, which could, without the capacitor conduct enough direct current to cause damage to any component or interfere with proper functioning of any part of the lighting system. The capacitor effectively prevents flow of any direct current. Since the additional capacitors are not employed for ballasting purposes in this application they are not required to store as much energy as in the case of a ballast capacitor and are therefore relatively inexpensive.

In one aspect of the invention, in cases where an inductive ballast is utilized, the additional capacitor may in some instances carry full lamp current, but with a small AC voltage drop so that dielectric power dissipation losses are negligible. In such cases a capacitor of relatively inexpensive construction such as a ceramic disk capacitor may be utilized. Preferably, such a capacitor should have a DC voltage rating in excess of the DC voltage resulting from a rectifying lamp. The capacitor need not have a high AC voltage rating.

In another aspect of the invention, the use of a single additional capacitor could prevent the flow of DC in both a ballast inductor and a filament transformer, or any other component that might be connected across one or more lamps for other purposes such as monitoring or energizing functions.

In still another aspect of the invention, in cases where a capacitive ballast does not prevent damage to the filament transformer, the additional capacitor connected in series with the primary winding of the filament transformer effectively blocks the DC current. The additional capacitor may be small since it operates at high frequency and low AC voltage. Preferably, an inexpensive ceramic disc capacitor can be used provided its DC voltage rating exceeds the maximum DC voltage that a rectifying lamp can generate, and this voltage will not exceed the peak open-circuit voltage available from the inverter.

In yet another aspect of the invention, an additional capacitor connected in series with the primary winding of the filament transformer protects the filament transformer from any potential damage that may be caused from the secondary windings being short circuited. This capacitor will operate at high frequency and have a relatively high voltage drop.

In yet another aspect of the invention, the ballast may be comprised of two capacitors in series, or a tapped inductor. The primary of the filament transformer may be connected to the junction of the capacitors or the tap of the inductor to provide added flexibility to control the voltage applied across the filament transformer.

BRIEF DESCRIPTION OF THE DRAWINGS

Some preferred embodiments of the invention are illustrated in the following drawings, in which like reference numerals indicate like parts and in which.

DETAILED DESCRIPTION OF THE PREFERRED EMBODIMENT

Figure 1:
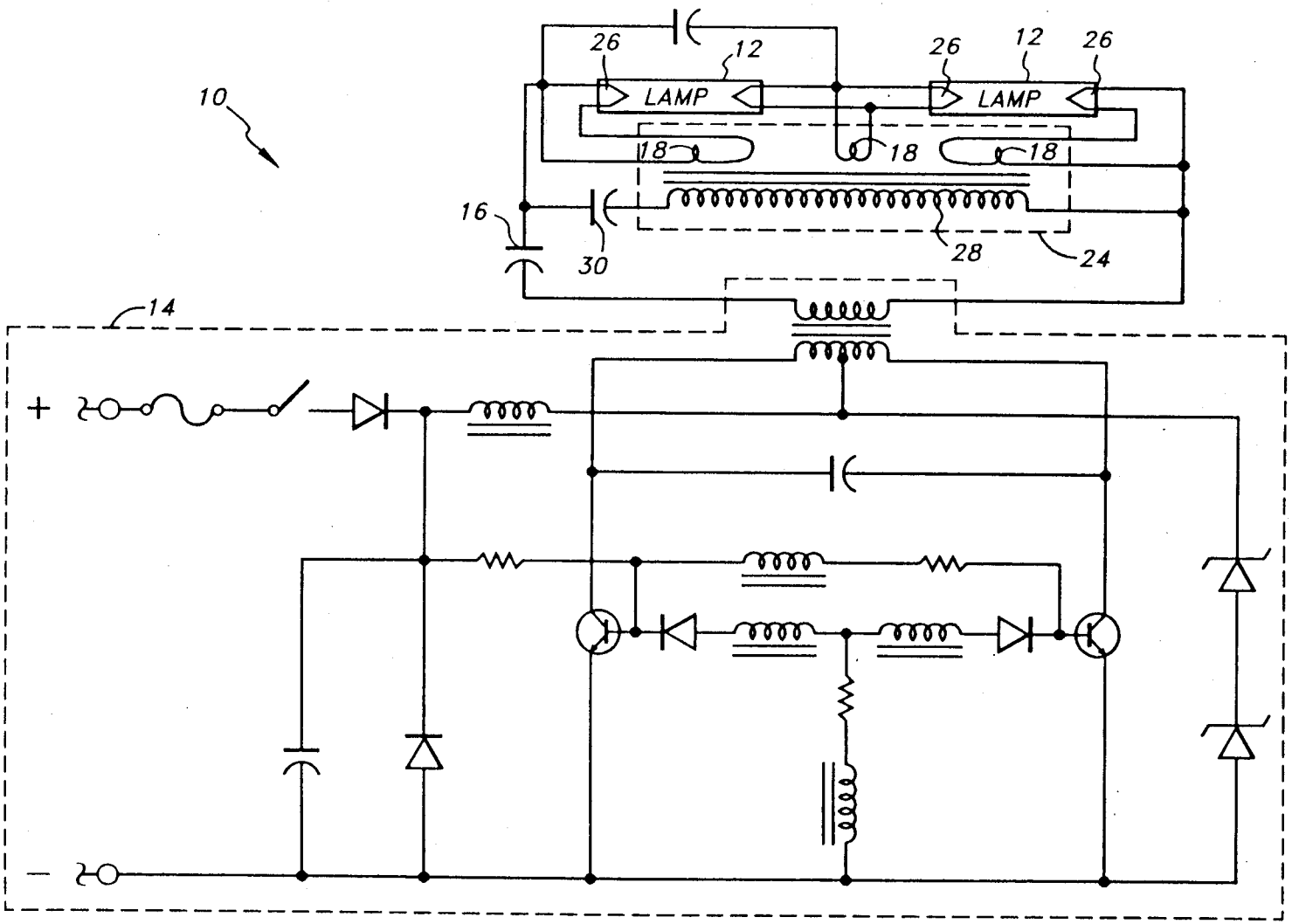
FIG. 1 is a schematic diagram of a preferred embodiment of an electronic ballast circuit and lamps in series illustrating the capacitor circuit for preventing damage by DC current generated by the lamp when it acts as a rectifier.
Figure 2:
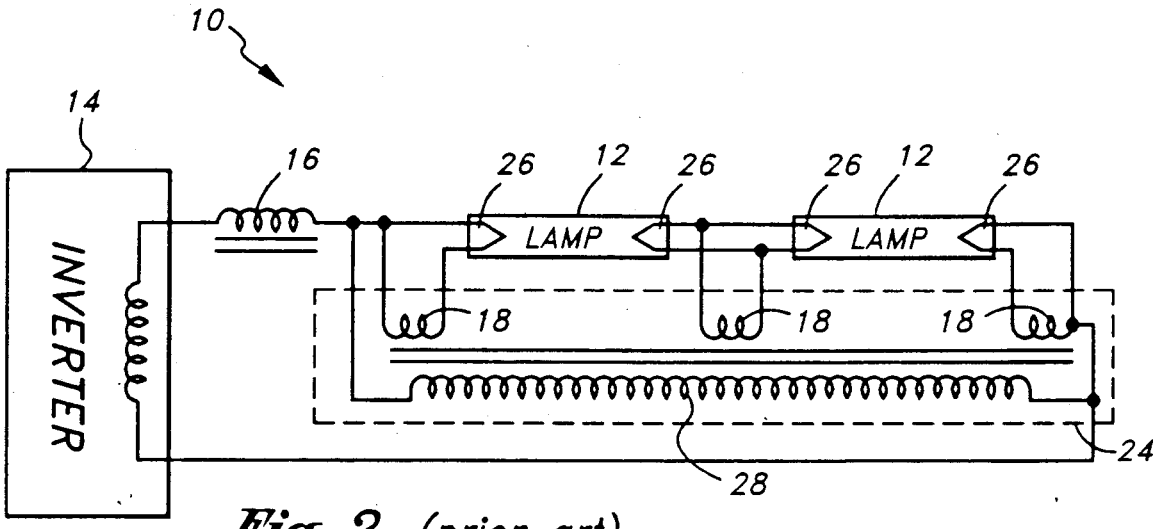
Fig. 2 (prior art)
FIG. 2 is a schematic diagram of a prior art electronic ballast circuit connected to two lamps illustrating an inductor circuit as a ballast or current limiting means and including a filament transformer.
Figure 3:
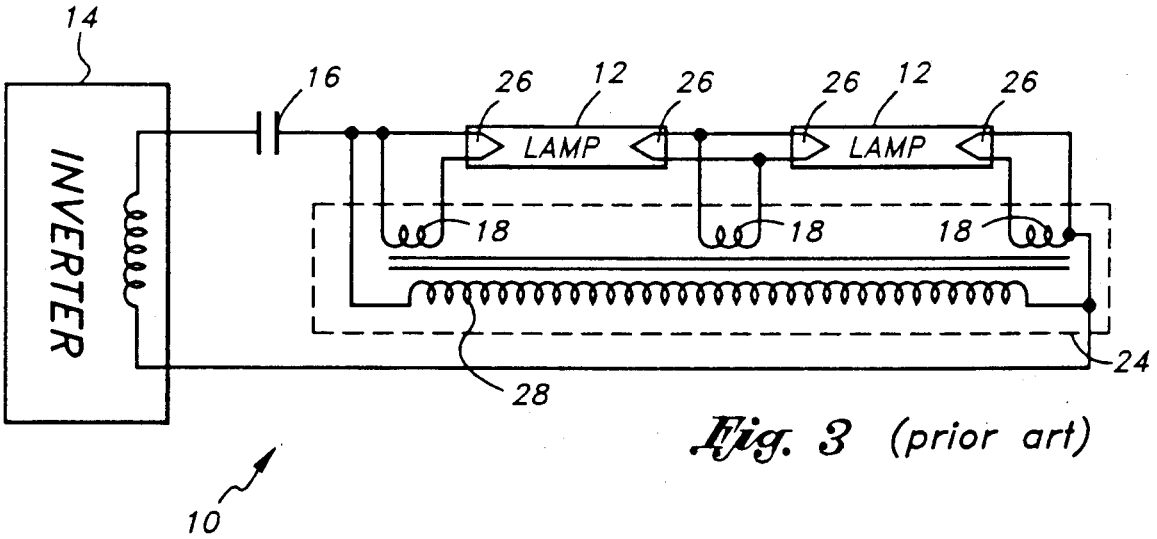
Fig. 3 (prior art)
FIG. 3 is a schematic diagram of a prior art electronic ballast circuit connected to two lamps illustrating a capacitor circuit as a ballast or current limiting means and including a filament transformer.

FIG. 1 illustrates an electronic ballast circuit 10 for high frequency applications with two lamps 12 connected in series. FIGS. 2 and 3 illustrate schematic diagrams of electronic ballasts known in the art. In all the illustrated Figures, comparable parts have the same reference numerals. Referring now to FIG. 2, there is shown an inverter 14 which converts direct current (DC) to high frequency alternating current (AC). This alternating current is applied to the lamps 12 through a ballast reactor 16. The ballast reactor 16 typically is a current limiting inductor or capacitor designed to control the flow of alternating current through a single or a plurality of lamps 12. A filament transformer 24 is sometimes included in the electronic ballast circuit 10 to heat the filaments of the lamps 12.

An important energy conserving feature is introduced by using the arc voltage of one or more lamps 12 to excite a primary winding 28 of the filament transformer 24 as shown in FIGS. 1–5. When power is first applied, and before arc current is established in the lamps 12, there is little current and little voltage drop in the ballast reactor 16. Consequently, substantially full output voltage of the inverter 14 is applied to the lamps 12 and to the primary winding 28 of the filament transformer 24. The secondary voltages of the filament transformer 24 are correspondingly high, causing the filaments 26 to heat quickly to the temperature needed for initiating the arc in each lamp 12. Arc current then causes a large voltage drop in the ballast reactor 16 which reduces the lamp voltage and all voltages on the filament transformer 24 to about half of their initial values. Once the arc is established, the filaments 26 are heated in part by arc current, and the filament voltages from a set of secondary windings 18 of the filament transformer 24 are reduced as described above to about half of their initial values to conserve energy in the filaments 26. The value of the energy conserved is more than enough to pay for the lamps. Little or no additional energy could be saved by turning the filaments 26 totally off as is often done by other means in the prior art. The remaining filament voltage is both sufficient in magnitude and of ideal phase to cause the hot spot which forms on each filament 26 to migrate from one end of the filament 26 to the other in an orderly manner throughout the life of the lamp 12, as is known by those skilled in the art to be necessary for long lamp life.

The filaments 26 at each end of each lamp 12 act alternately as cathodes when negative, or as anodes when positive. The filaments 26 are coated with mixed oxides of the alkaline earth elements. The heated oxides emit electrons into the surrounding space when the filaments 26 act as cathodes. Over the life of the lamps 12, the oxide coatings are consumed, and eventually the filaments 26 lose their ability to emit electrons. If, as commonly happens, the oxide coating of the cathode at one end of the lamp 12 deteriorates before that of the cathode at the other end, the lamp 12 conducts current more readily in one direction than in the other, thus acting as a rectifier and generating DC current.

In the prior art, as illustrated in FIG. 2, DC current follows the available path through the primary winding 28 of the filament transformer 24 or alternatively a path through the ballast reactor 16 and further to the windings in the inverter 14, thereby causing damage to any components 14, 16 or 28 of the electronic ballast 10. FIG. 3 illustrates a similar prior art circuit wherein the ballast reactor 16 is a capacitor rather than an inductor as shown in FIG. 2. FIG. 3 is different from FIG. 2 only in that the ballast reactor 16 utilizes a capacitor circuit rather than an inductor circuit. In this instance, DC current produced by the lamp 12 does not have any detrimental effects on the inverter 14 or the ballast reactor 16, but may still damage the primary winding 28 of the filament transformer 24.

Referring now to FIG. 1, there is illustrated a circuit for preventing damage from failure of floresoent lamps in accordance with the present invention. In a preferred embodiment of the present invention, a capacitor 30 is connected in series with the primary winding 28 of the filament transformer 24. The series combination of the primary winding 28 of the filament transformer 24 and the capacitor 30 is connected across the lamps 12. As a result of adding the capacitor 30, the path for DC current through the primary winding 28 is eliminated. Therefore, the filament transformer 24 cannot be damaged by DC produced by the lamps 12. It should be apparent to one skilled in the art that a capacitor 30 may be connected in series with every path through the lamps 12, which could without the capacitor 30, conduct direct current to cause damage to any component. The DC voltage rating of the capacitor 30 need only exceed the peak open-circuit voltage available from the inverter 14. In an exemplary embodiment the capacitor 30 has a capacitance of 0.01 microfarad, which is adequate for use at a frequency of 24 KHz. In addition, the capacitor 30 is advantageously an inexpensive ceramic disk capacitor.

Figure 4:
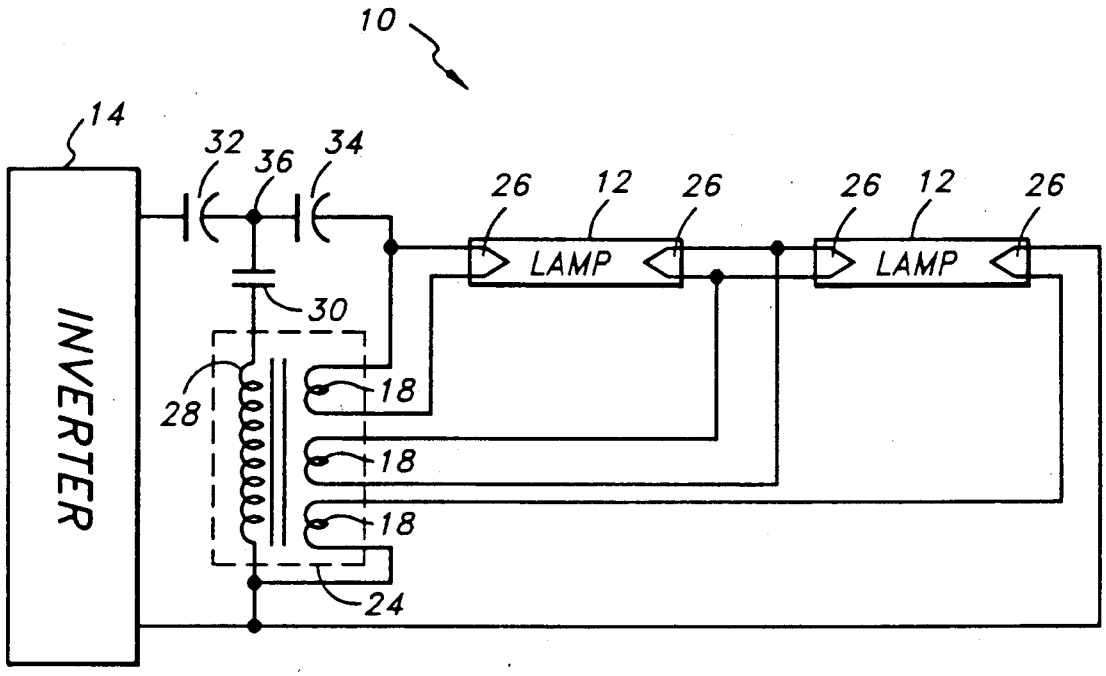
FIG. 4 is a schematic diagram of an alternative embodiment of the present invention illustrating a split capacitor as a ballast.
Figure 5:
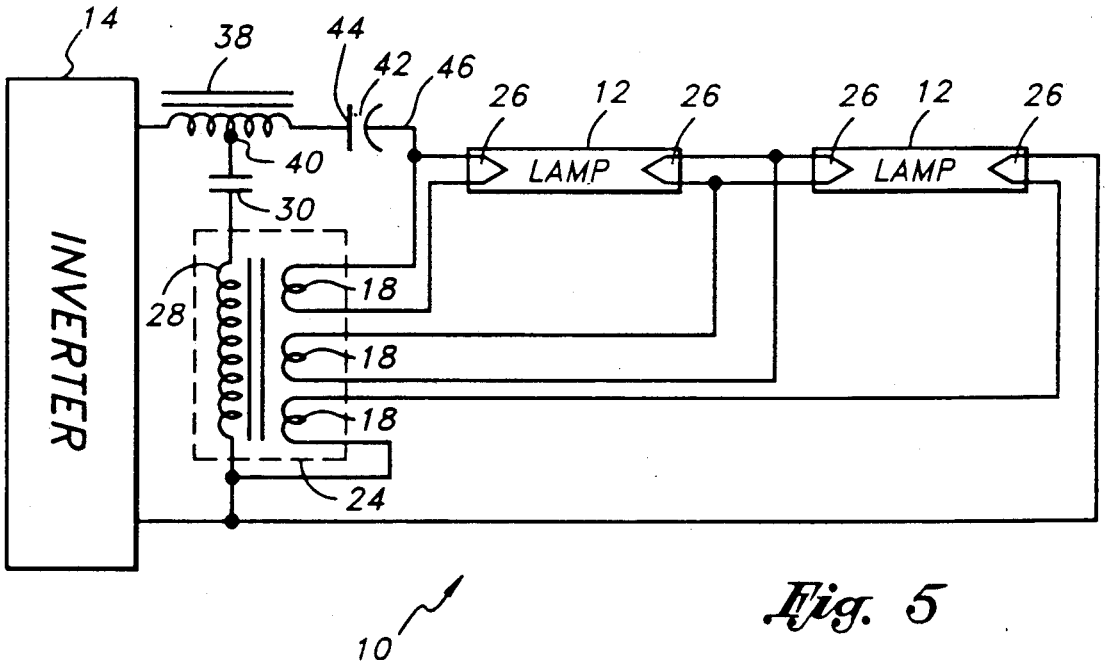
FIG. 5 is a schematic diagram of an alternative embodiment of the present invention illustrating a tapped inductor circuit as a ballast and a capacitor circuit for preventing damage by DC current generated by the lamp when it acts as a rectifier.

There is another useful mode of operation using the capacitor 30 with a smaller value of capacitance to add a substantial impedance in series with the primary 28 of the filament transformer 24. The added impedance of capacitor 30 limits the amount of AC current which can flow in the filament transformer 24 and protects the transformer 24 in the event the secondary winding 18 inadvertently becomes short-circuited. The capacitor 30, of course, also continues to keep direct current from flowing through the primary winding 28. As shown in FIGS. 4 and 5, capacitor 30 is used only for limiting short-circuit alternating current because direct current is already blocked by the otherwise existing capacitor 34 or 42.

In addition, the filament transformer 24 in FIGS. 1–5 may be designed to operate as either a normal voltage transformer or a current transformer. When used as a current transformer, the primary current is controlled by the capacitor 30 and by the voltage appearing across the series combination of the capacitor 30 and the primary winding 28 of the filament transformer 24. Secondary currents are as desired proportional to the primary current.

Referring now to FIG. 4, there is illustrated an alternative embodiment of the present invention which together with preventing damage to the electronic ballast 10, also allows additional freedom in controlling the filament voltage of the lamps 12. The lamps 12 are ballasted by a combination of a first capacitor 32 in series with a second capacitor 34. The primary winding 28 of the filament transformer 24 is connected on one end to the negative return and on the other end to the capacitor 30. The other end of the capacitor 30 is connected to a junction point 36 between the first ballast capacitor 32 and the second ballast capacitor 34. As explained above, the voltage across the lamps 12 and all windings 18 and 28 of the filament transformer 24 are reduced after the lamps 12 have turned on. This configuration employing the split capacitor combination of the first and second capacitors 32 and 34 advantageously protects all the components from the lamps 12 when they become rectifying. As is apparent from FIG. 4, the second capacitor 34 advantageously reduces the operating voltage of the lamps 12 in addition to preventing direct current from flowing anywhere in the circuit.

In some instances, the approximately 50 percent reduction of filament voltage after lamp 12 ignition, that was explained above, may be excessive. Reductions of less than 50 percent can be obtained by splitting the ballast reactor 16 into two series components as illustrated in FIGS. 4 and 5. In FIG. 4, the ballast capacitors 32 and 34 share the voltage drop which occurs between the inverter 14 and the lamps 12. Only the voltage drop in capacitor 32 is effective in reducing voltages applied to filaments 26 through the filament transformer 24. By suitably proportioning the values of the capacitors 32 and 34 any degree of filament voltage reduction after starting from 0 to approximately 50 percent can be achieved. In an exemplary embodiment, the filament voltage can be reduced by 25 percent after starting, if capacitors 32 and 34 are each 0.01 microfarad. Each capacitor 32 and 34 needs only one-half of the voltage rating that a single ballast capacitor 16 would need.

Similarly, FIG. 5 shows how a ballast inductor 38 may be split into two separate components or, equivalently, can be tapped at a junction point 40 to reduce the voltage applied to the filament transformer 24. The proportioning of the inductor 38 or the location of the tap point 40 determines the degree of reduction of filament voltage after the lamps 12 start. The primary winding 28 of the filament transformer 24 is connected to the capacitor 30. The other end of the capacitor 30 is connected to the junction 40 of the tapped inductor 38. Depending on the position of the junction 40, the primary voltage of the filament transformer 24 can be reduced after the lamps 12 turn on to any value between that of the inverter 14 and that of the lamps 12. As understood to one skilled in the art, the junction 40 may be placed at the inverter 14 end of the tapped inductor 38 to provide a constant filament voltage. In this situation, the junction 40 and the end point of the tapped inductor 38 are identical, and therefore an inductor without a tap would have the same effect. The tapped inductor 38 does not provide protection to the components of the electronic ballast 10 from DC produced by the lamps 12 when they are rectifying. Therefore, a capacitor 42 is preferably inserted to prevent flow of DC through the tapped inductor 38, the inverter 14 or the filament transformer 24. The capacitor 42 at a first end 44 is connected to the tapped inductor 38, and on a second end 46 is connected to the lamp 12. Again, as is apparent from FIG. 5, the capacitor 42 advantageously prevents direct current from flowing anywhere in the circuit.

Having described the invention in connection with certain preferred embodiments thereof, it will be understood that many modifications and variations thereto are possible, all of which fall within the true spirit and scope of this invention.

What is claimed is:

1. A high frequency lighting system comprising:

a power supply;

at least one gas discharge lamp;

an inverter for providing high-frequency alternating current from said power supply to said gas discharge lamp;

a ballast means connected in series with said gas discharge lamp, said ballast means limiting current flow through said gas discharge lamp; and means for preventing damage to said inverter and said ballast means connected in series with said lamp, said means preventing flow of direct current produced in said lamp through said inverter and said ballast means.

2. A high frequency lighting system, as defined in claim 1, wherein said means for preventing damage comprises a capacitor, and wherein said ballast means is an inductor.

3. A high frequency lighting system, as defined in claim 1, wherein said means for preventing damage comprises a first capacitor, and wherein said ballast means is a second capacitor different from said first capacitor.

4. An electronic ballast for operating at least one high frequency gas discharge lamp, comprising:

an inverter for providing high-frequency alternating current to said gas discharge lamp;

a ballast means connected to said gas discharge lamp, said ballast means limiting current flow through said gas discharge lamp;

a filament transformer having a primary and at least one secondary winding; and means for preventing damage to said filament transformer, said means connected in series with said primary winding of said filament transformer, the series combination of said means and said filament transformer being connected in parallel with said lamp, said means preventing flow of direct current produced in said lamp through said filament transformer.

5. An electronic ballast for operating at least one high frequency gas discharge lamp as defined in claim 4, wherein said means for preventing damage comprises a capacitor.

6. An electronic ballast as defined in claim 4, wherein a plurality of said lamps are connected in series, said plurality of lamps in series being connected in parallel with the series combination of said filament transformer and said means for preventing damage.

7. An electronic ballast for operating at least one high frequency gas discharge lamp as defined in claim 4, wherein said filament transformer provides high starting power for heating said lamp before said lamp turns on, said filament transformer providing reduced power once said lamp is on.

8. An electronic ballast for operating at least one high frequency gas discharge lamp, comprising:

a current limiter connected substantially in series with said gas discharge lamp which limits alternating current flow through said gas discharge lamp;

a filament transformer having a primary and a secondary winding; and a capacitor which prevents damage to said filament transformer, said capacitor connected in series with said primary winding of said filament transformer, the series combination of said capacitor and said filament transformer being connected in parallel with said lamp, said capacitor preventing the flow of direct current produced in said lamp through said filament transformer.

9. An electronic ballast for operating at least one high frequency gas discharge lamp as defined in claim 8, wherein said current limiter comprises a capacitor.

10. An electronic ballast for operating at least one high frequency gas discharge lamp as defined in claim 8, wherein said current limiter comprises an inductor.

11. A method for preventing damage to an electronic ballast for high frequency gas discharge lamps, in which a primary winding of a filament transformer receives an alternating current exciting voltage from one or more of the gas discharge lamps, comprising the steps of:

limiting AC current flow through said gas discharge lamp; and preventing DC current produced in said lamp from flowing in the primary of said filament transformer.

12. A method for preventing damage to an electronic ballast for high frequency gas discharge lamps as defined in claim 11, wherein said step of preventing DC current comprises connecting a capacitor in series with said filament transformer.

13. A method for preventing damage to an electronic ballast for high frequency gas discharge lamps as defined in claim 11, also comprising the steps of:

preventing DC current produced in said lamp from flowing in the components of said electronic ballast.

14. An electronic ballast for operating at least one high frequency gas discharge lamp, comprising:

an inverter for providing high-frequency alternating current to said gas discharge lamp;

a ballast for limiting current flow through said gas discharge lamp, said ballast having a first end, a center junction and a second end, said first end connected to said inverter;

a first capacitor connected in series with said gas discharge lamp, said first capacitor preventing damage to said electronic ballast, said first capacitor also reducing the operating current of said lamps; and a filament transformer having a primary and at least one secondary winding, said primary winding connected in parallel with the series combination of said gas discharge lamp and said first capacitor, said first capacitor also being connected to said second end of said ballast, said primary at a first end connected to said junction and at a second end to a return line from the lamp to said inverter.

15. An electronic ballast as defined in claim 14, wherein a plurality of gas discharge lamps are connected in series.

16. An electronic ballast for operating at least one high frequency gas discharge lamp, comprising:

an inverter for providing high-frequency alternating current to said gas discharge lamp;

a first capacitor for limiting current flow through said gas discharge lamp, said first capacitor having a first terminal and a second terminal, said first terminal connected to said inverter;

a filament transformer having a primary and at least one secondary winding, said primary having a first end and a second end, said first end connected to said second terminal of said first capacitor, and said second end connected to said inverter; and a second capacitor connected in series with said gas discharge lamp, said second capacitor preventing damage to said filament transformer by preventing direct current produced in said lamp from flowing through said filament transformer, said second capacitor also reducing the operating current of said lamp.

17. An electronic ballast for operating at least one high frequency gas discharge lamp, comprising:

an inverter for providing high-frequency alternating current to said gas discharge lamp;

a tapped inductor for limiting current flow through said gas discharge lamp, said tapped inductor having a first end, a second end and a tap, said first end connected to said inverter;

a capacitor connected in series with said gas discharge lamp, said capacitor preventing damage to said electronic ballast by preventing direct current produced by said lamp from flowing through the electronic ballast; and a filament transformer having a primary and a secondary winding, said primary winding at a first end connected to said tap and at a second end connected to said inverter, said filament transformer having a voltage being increased above a voltage across said lamp by said tapped inductor circuit.

18. An electronic ballast for operating at least one high frequency gas discharge lamp comprising:

an inverter for providing high-frequency alternating current to said gas discharge lamp;

a ballast means connected to said gas discharge lamp for limiting current flow through said gas discharge lamp;

a filament transformer having a primary and at least one secondary winding; and means for preventing damage to said filament transformer, said means connected in series with said primary winding of said filament transformer said means preventing damage from a short circuited secondary of said filament transformer.

19. An electronic ballast for operating high frequency gas discharge lamps, as defined in claim 18, wherein said means for preventing damage to filament transformer is a capacitor.

20. An electronic ballast as defined in claim 14, further comprising:

means for preventing damage to said filament transformer, said means connected in series with said primary winding of said filament transformer said means preventing damage from a short circuited secondary of said filament transformer.

21. An electronic ballast, as defined in claim 20, wherein said means for preventing damage to said filament transformer is a second capacitor different from said ballast or said first capacitor.

22. An electronic ballast for operating at least one high frequency gas discharge lamp, comprising:

an inverter for providing high-frequency alternating current to said gas discharge lamp;

a first capacitor for limiting alternating current flow through said gas discharge lamp, said first capacitor having a first terminal and a second terminal, said first terminal connected to said inverter;

a filament transformer having a primary and at least one secondary winding, said primary having a first end and a second end, said second end connected to a return one from the lamp to said inverter; and a second capacitor which prevents damage to said filament transformer by preventing direct current produced in said lamp from flowing through said filament transformer, said second capacitor connected to said second terminal of said first capacitor and connected to said first end of said primary.

23. An electronic ballast for operating at least one high frequency gas discharge lamp, comprising:

an inverter which provides high-frequency alternating current to said gas discharge lamp;

a ballast impedance which limits current flow through said gas discharge lamp, and said ballast impedance having a tap point; and a filament transformer having a primary and a at least one secondary winding, said primary winding having a first and a second end, said first end connected to said tap point, said tap point selected to adjust for a pre-selected reduction in the filament operating voltage after the lamp ignites, said second end connected to a return line from the lamp to said inverter.

24. The electronic ballast of claim 23, wherein said ballast comprises a tapped inductor.

25. The electronic ballast of claim 23, wherein said ballast comprises a combination of at least two capacitors.

* * * * *